US007231975B2

(12) United States Patent
Lavaure et al.

(10) Patent No.: US 7,231,975 B2
(45) Date of Patent: Jun. 19, 2007

(54) BOREHOLE STABILISATION

(75) Inventors: Gilbert Lavaure, Saint Alban Auriolles (FR); Claude Vercaemer, London (GB); Dominique Guillot, Clamart Cedex (FR); Marc Thiercelin, Moscow (RU)

(73) Assignee: Schlumberger Technology Corporation, Surgar Land, TX (US)

( * ) Notice: Subject to any disclaimer, the term of this patent is extended or adjusted under 35 U.S.C. 154(b) by 312 days.

(21) Appl. No.: 10/492,398

(22) PCT Filed: Sep. 25, 2002

(86) PCT No.: PCT/EP02/11182

§ 371 (c)(1),
(2), (4) Date: Aug. 24, 2004

(87) PCT Pub. No.: WO03/031768

PCT Pub. Date: Apr. 17, 2003

(65) Prior Publication Data

US 2004/0261998 A1 Dec. 30, 2004

(30) Foreign Application Priority Data

Oct. 8, 2001 (EP) ..... 01402583

(51) Int. Cl.
*E21B 33/00* (2006.01)

(52) U.S. Cl. ..... 166/285; 166/380

(58) Field of Classification Search ..... None
See application file for complete search history.

(56) References Cited

U.S. PATENT DOCUMENTS 5,253,708 A * 10/1993 Alexander ..... 166/278
5,346,007 A * 9/1994 Dillon et al. ..... 166/278
5,842,518 A * 12/1998 Soybel et al. ..... 166/287

* cited by examiner

*Primary Examiner*—Frank Tsay
(74) *Attorney, Agent, or Firm*—Darla Fonseca; David Cate; Robin Nava

(57) ABSTRACT

A method for stabilising an unconsolidated zone (18) of a borehole, by forming a region of the borehole having enlarged diameter (22) in the unconsolidated zone; positioning a fluid-filled casing (26) in the borehole the liner having a pipe (28) extending therethrough into a lower portion; pumping cement from the surface inside the pipe so as to exit the liner at the lower portion and flow upwards to fill the annulus (44) formed between the outside of the liner and the borehole in the unconsolidated zone; withdrawing the pipe (28) from the casing while pumping fluid therethrough so as to maintain the liner substantially fluid-filled and to displace cement above the liner in the adjacent region; drilling through the cement and liner in the unconsolidated zone after the cement has set.

16 Claims, 8 Drawing Sheets

BOREHOLE STABILISATION

The present invention relates to borehole stabilisation and is particularly applicable to methods for stabilising boreholes involving the use of drillable liners or casings.

The cementing of casings in boreholes for stabilisation and zonal isolation is well known, especially in the field of well construction in the oil and gas industry. Such operations are performed at various stages while the well is being drilled. In a casing operation, the drill string used to drill the borehole is withdrawn and a tubular casing run into the borehole such that a space is left between the outer surface of the casing and the wall of the borehole (an annulus). Cement slurry is then pumped down the inside of the casing such that it exits the casing at the bottom and flow back towards the surface in the annulus. When the cement sets, the casing is fixed in the borehole and the various layers through which the borehole passes are supported and isolated by the cement and casing. Drilling is then resumed, but at a smaller diameter than previously because of the presence of the casing.

Setting casing can be useful to support a weak formation or to seal off zones of high or low pressure to prevent uncontrolled influx of fluids or damage to the formation due to the use of dense drilling fluids to balance high formation pressures. For deep wells, it can be necessary to set casing several times before the borehole is drilled to the target depth. Since each casing reduces the diameter of the borehole below that point, planning of the well can be difficult to stay within established drilling practices or reasonable cost while still obtaining a well of useful size. In certain cases, as many as ten casing operations have been necessary.

One reason for setting casing is to support a weakly consolidated formation that is becoming worn away as drilling proceeds or that can be fractured. In such cases, the level of reinforcement required can be obtained from a relatively thin layer of cement alone without the need for casing to be present, especially where strong cements such as fibre-reinforced cements are used. It has been previously proposed to stabilise such zones by enlarging the borehole in that zone by under-reaming and setting a short section of casing across the zone and cementing it in. After the cement has set, the casing and some of the cement is drilled out at the same diameter as was being used before the cementing operation, leaving the under-reamed section with a layer of cement on the borehole wall. Such an operation is described in U.S. Pat. No. 5,842,518, and other operations involving drillable casing are described in U.S. Pat. No. 5,957,225.

Another approach to the problem of reduction of borehole diameter when installing several casings is described in U.S. Pat. No. 6,098,710 and U.S. Pat. No. 6,267,181. In this case a special casing tool is used to avoid the need for an annulus in the zone above by diverting fluid flow back into the borehole. Since this allows the use of casing of substantially the same diameter as that above, it is not necessary to drill out the casing when continuing with the drilling operation.

It is an object of the invention to provide methods and apparatus which allow weak zones of boreholes to be supported without excessively reducing the diameter of the borehole at that point.

One aspect of the present invention provides a method of stabilising a zone of interest of a borehole, comprising:

(i) forming a region of the borehole having enlarged diameter in the zone of interest when compared to the adjacent zone above;

(ii) positioning a liner in the borehole extending across the zone of interest and into the adjacent zone above, the liner having a pipe extending therethrough to a lower portion and being connected to a cement supply at the surface;

(iii) pumping cement from the surface inside the pipe so as to exit the liner at the lower portion and flow upwards to fill the annulus formed between the outside of the liner and the borehole in the zone of interest and to extend into the adjacent zone above;

(iv) withdrawing the pipe from the liner; and (v) drilling through the cement and liner in the zone of interest after the cement has set to form a borehole of substantially similar diameter to that of the adjacent zone above.

The portion of the liner extending into the adjacent zone above preferably has a smaller diameter than that part of the liner in the zone of interest. By reducing the diameter of the liner at its upper part, it is possible to avoid a flow restriction in the annulus at the point where the liner enters the zone above. Alternatively, the liner can be of substantially constant diameter with sufficient clearance in the upper zone to allow proper cement placement. By extending the cement sheath in the zone above, the sheath is anchored in the upper zone leading to better stability. The term "liner" used here refers equally to casings.

It is preferred that the liner be in a fluid filled state when placed in the zone, and that fluid be pumped through the pipe as it is withdrawn from the liner so as to maintain the fluid-filled state and to displace any cement above the liner in the zone above. The fluid used to fill the liner can typically be a heavy mud or other fluid so as to prevent buoyancy of the liner when installed in the well.

The zone above the zone of interest can be an open, well-consolidated and stable zone, of can be lined with cemented casing or sheath. Alternatively, it can be a zone that has been previously stabilised by use of a drilled liner, either according to the present invention or by another method. The region of enlarged diameter can be formed using an under-reamer or a bi-centre bit. It is preferred that a bit pilot hole is provided at the bottom of the enlarged section.

The pipe in the liner is preferably drill pipe and the liner is connected to the drill pipe by means of a setting tool. This can connect to the upper part of the liner by means of a threaded connector or any other releasable connector. Centralisers can be provided to centralise the liner, both in the zone of interest and in the zone above. A dart landing sub can be provided inside the drill pipe near the bottom thereof.

The drill pipe also can be connected to a float shoe at the bottom of the liner which has side ports for communication with the annulus and cross webs to engage in the pilot hole. Centralisers can be provided for centralising the drill pipe in the liner.

When the cement has been placed, the drill pipe is disconnected from the liner and displacing fluid circulated through the drill pipe inside the liner to prevent cement from filling the liner and to displace cement above the liner.

The cement used is preferably a fibre-reinforced cement. The fibres can be metallic or formed from a suitable polymeric material. Low density, non-foamed slurries are preferred.

The steps described above can also be preceded by installing a casing in the zone above which has a drillable oversized casing shoe into which the liner is installed and cemented.

The methods of the present invention can be used for stabilising "problem zones" of boreholes in different situations, for example: in formations with mechanical stability problems, formations experiencing shear failure or plastic flow, unconsolidated formations, formations with narrow pore or fracture gradient margins or narrow kick or loss windows, and formations susceptible to differential sticking problems due to large differences between drilling fluid hydrostatic pressure and formation pressure. In particular, the method has application to zones which need to be drilled either with a mud weight lower than the stability window, or higher than the fracture gradient, in order to save a casing point, or when there is no safe mud weight.

The invention will now be described by way if example, with reference to the accompanying drawings, in which.

Figure 1:
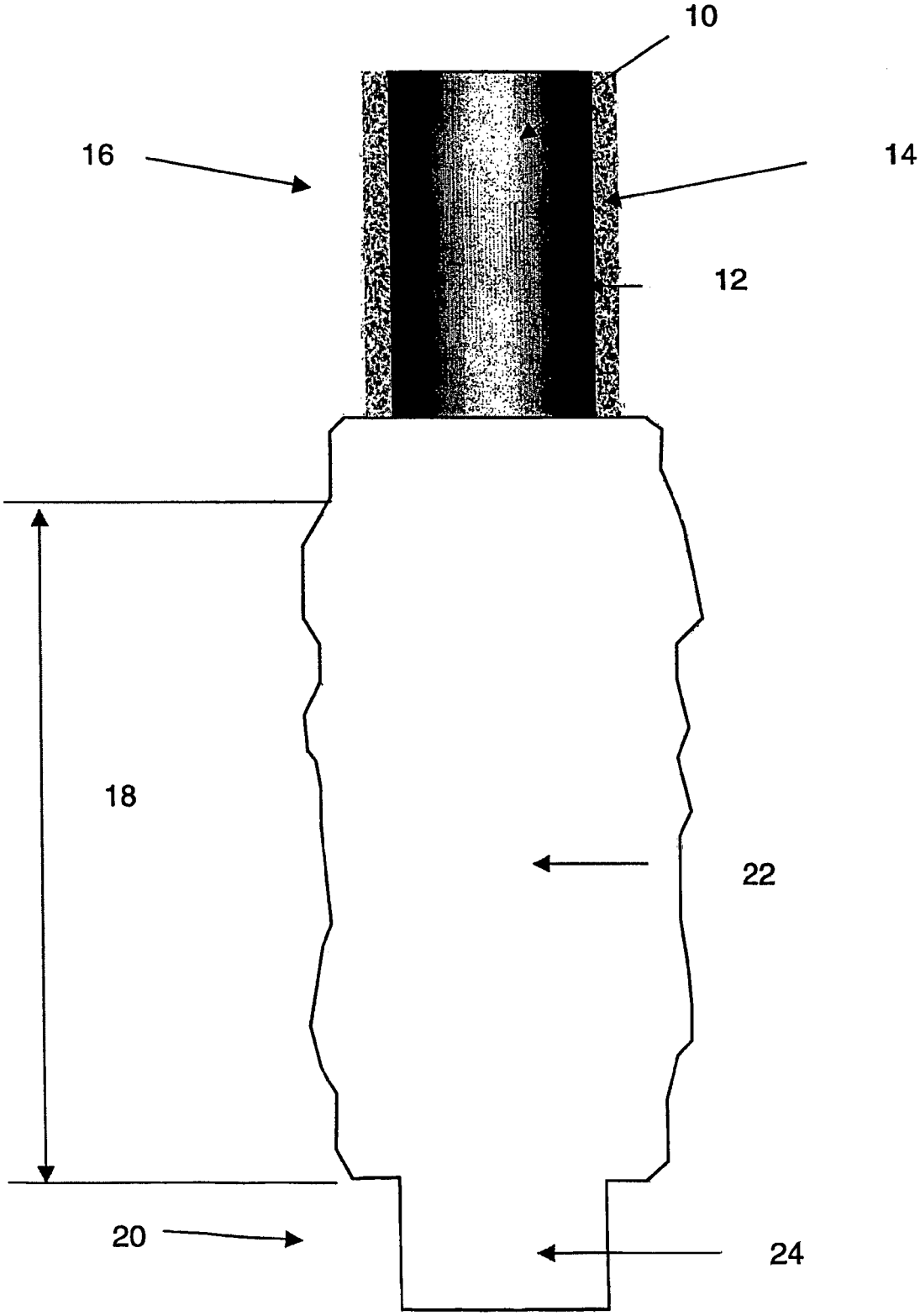
FIG. 1 shows a portion of a borehole extending through an problem zone.

FIG. 1 shows a partial example of a borehole to which the invention typically applies. The borehole 10 has been drilled from the surface and at least one casing 12 has been cemented 14 to stabilise and isolate the zones penetrated 16. Further drilling has caused the borehole to enter a relatively thin problem zone 18. This formation can be one that has mechanical stability problems, a formation experiencing shear failure or creep (plastic flow), an unconsolidated formation (salt, coal, shale, etc.), a formation with narrow pore or fracture gradient margins or narrow kick or loss windows, or a formation susceptible to differential sticking problems due to large differences between drilling fluid hydrostatic pressure and formation pressure. In such cases, there can be great danger of drilling problems such as sticking, fluid loss or influx (kick), even though the zones below 20 might be stable. In order to prepare the borehole for stabilisation according to the invention, the diameter of the borehole in the problem zone 18 has been enlarged 22 using an under-reamer or bi-centre bit (not shown). A bit pilot hole 24 is formed at the bottom of the enlarged zone 22.

Figure 2:
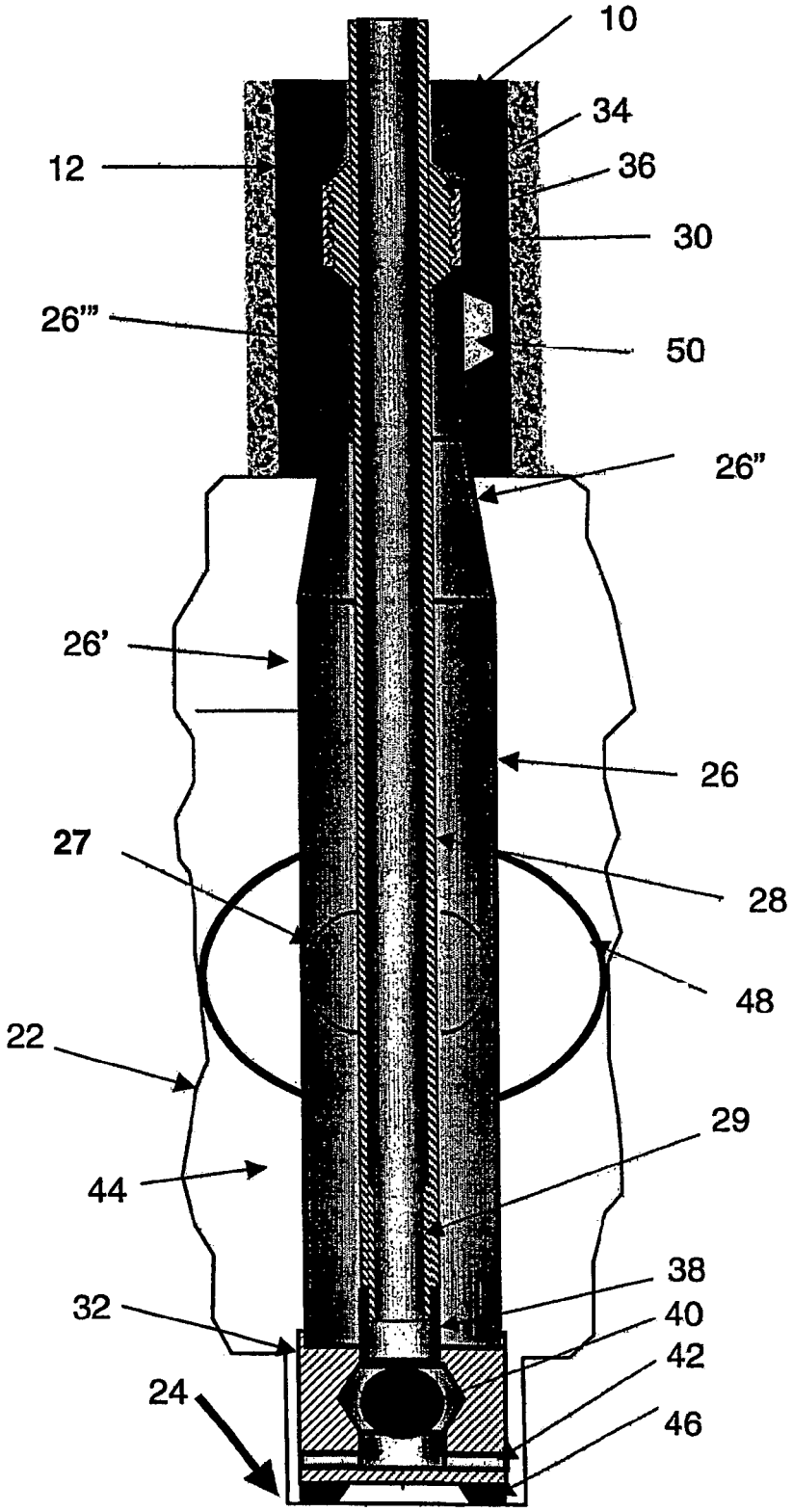
FIG. 2 shows the installation of drillable liner into the problem zone.

Referring now to FIG. 2, a fluid-filled, drillable liner 26 is run into the borehole 10 on drill pipe 28, so as to extend through the enlarged zone 22. The liner 26 is supported on the drill pipe 28 by means of a liner setting tool 30 at the top and a float shoe 32 at the bottom. The liner setting tool 30 has a threaded portion 34 which engages corresponding threads 36 in the liner 26. The lower part of the drill pipe 28 includes a dart landing sub 29 and connects to the float shoe 32 by means of a stab-in receptacle 38. Centralisers 27 are provided on the drill pipe 28 to allow centralisation in the liner 26 and to facilitate connection with the float shoe 32. The float shoe 32 also includes a self-filling float valve 40 and side ports 42 that provide a fluid connection between the drill pipe 28 and the annulus 44 outside the liner 10. The float shoe 32 also includes cross webs 46 at its lower end which engage the formation at the bottom of the pilot hole 24 when the liner is set on bottom.

The main part 26' of the liner 26 has a diameter that is marginally smaller than that of the casing 12 above the enlarged zone 22. The portion 26''' of the liner 26 extending into the casing 12 above has a smaller diameter in order that sufficient annular space for fluid flow is obtained and the portion 26'' of the liner 26 joining the upper 26''' and lower 26' parts has a progressive diameter change (shell head) in order that there is no flow restriction between the annulus in the enlarged region 22 and the annulus in the casing 12 above.

The liner 26 is centralised in the enlarged zone 22 by bow spring centralisers 48 and in the upper casing 12 by smaller blade centralisers 50. The centralisers 48, 50 can be made of metal, metal composites or other fibre reinforced materials. Apart from their centralising role, it is important that both of these should be drillable, if possible in a manner that will not affect any cement in which they may be embedded. While blade and bow spring centralisers are shown here, any other form can be used, if appropriate.

Figure 3:
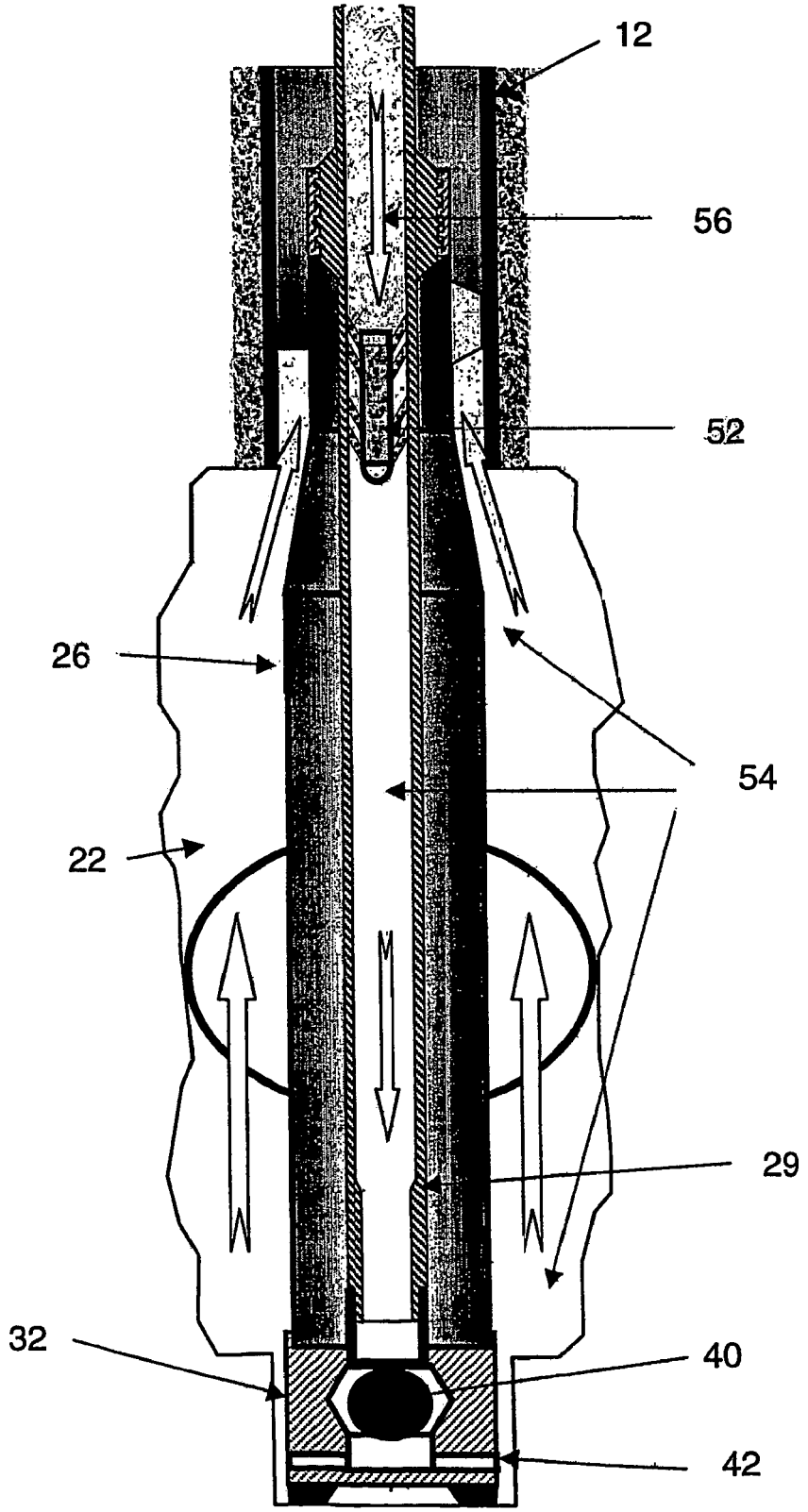
FIG. 3 shows cement being pumped into the annulus of the problem zone.

Referring to FIG. 3, cement 54 is pumped from the surface down the inside of the drill pipe 28. The cement used is a low density fibre-reinforced slurry, containing metal fibres to provide a stronger structure when set. The quantity of slurry pumped from the surface is sufficient to fill the annulus 22 and to extend partly into the cased zone 12. Once a sufficient amount of slurry 54 has been pumped into the drill string 28, a dart 52 is released and pumped down the drill pipe 28 with a displacing fluid 56. The cement 54 exits the float shoe 32 via the side ports 42 and fills the annulus 22 as shown.

Figure 4:
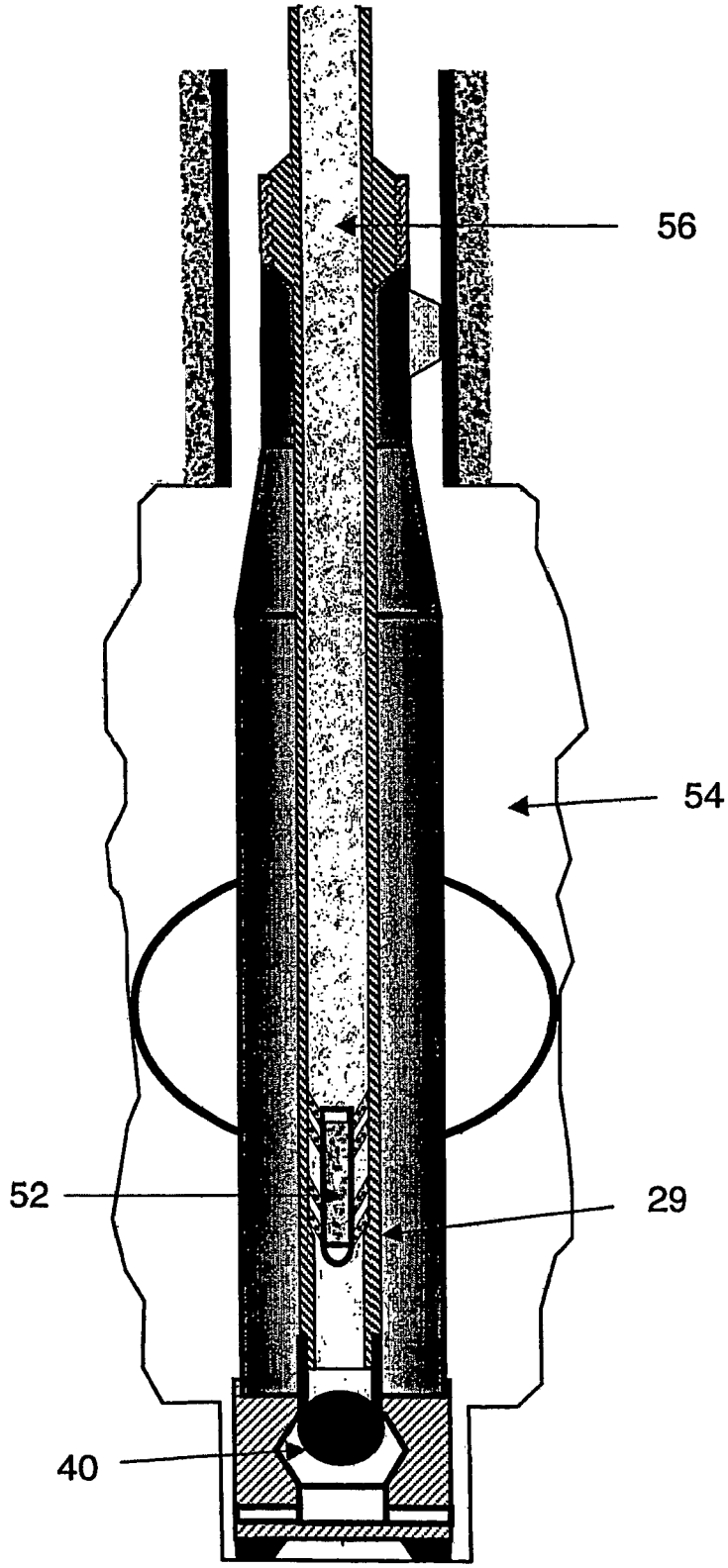
FIG. 4 shows a dart landing in the drill pipe at the end of cementing.

When the dart 52 reaches the landing sub 29, a pressure bump is detected at the surface and pumping is stopped. At this point, the float valve 40 closes and prevents cement 54 from returning into the liner or drill pipe 28 (FIG. 4).

Figure 5:
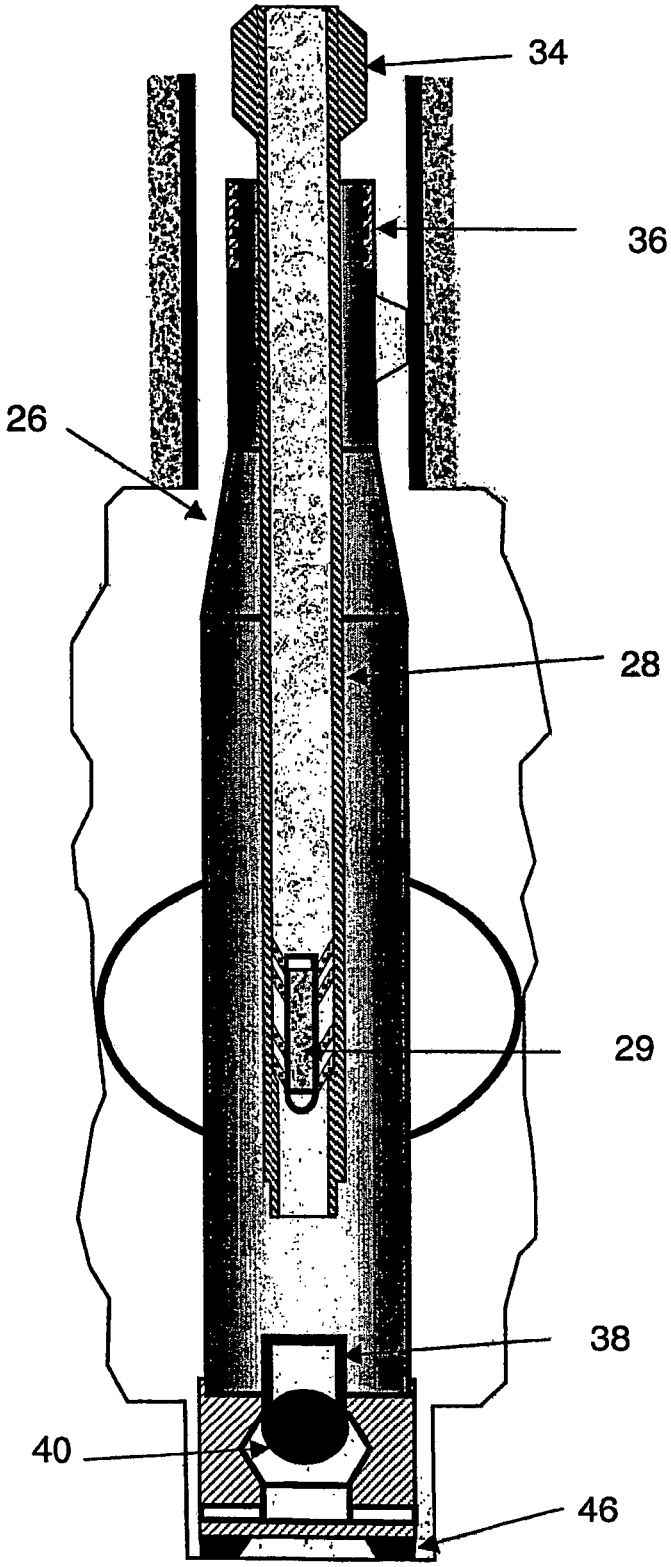
FIG. 5 shows the drill pipe as it is withdrawn from the liner.

Once pumping has stopped, the setting tool 30 is disconnected from the liner 26 by unscrewing the threaded connectors 34, 36, the webs 46 holding the liner 26 against rotation, and the lower end of the drill pipe 28 is withdrawn from the stab in connector 38. The pressure in the drill pipe 28 is raised to a sufficient level to rupture a disc in the dart 52 and allow fluid communication between the drill pipe 28 and the inside of the liner 26. As the drill pipe 28 is withdrawn from the liner 26, displacing fluid 56 is pumped to ensure that the cement 54 is not drawn into the liner 26 and to displace cement 54 in the cased zone 12 above the liner 26 (FIG. 5).

Figure 6:
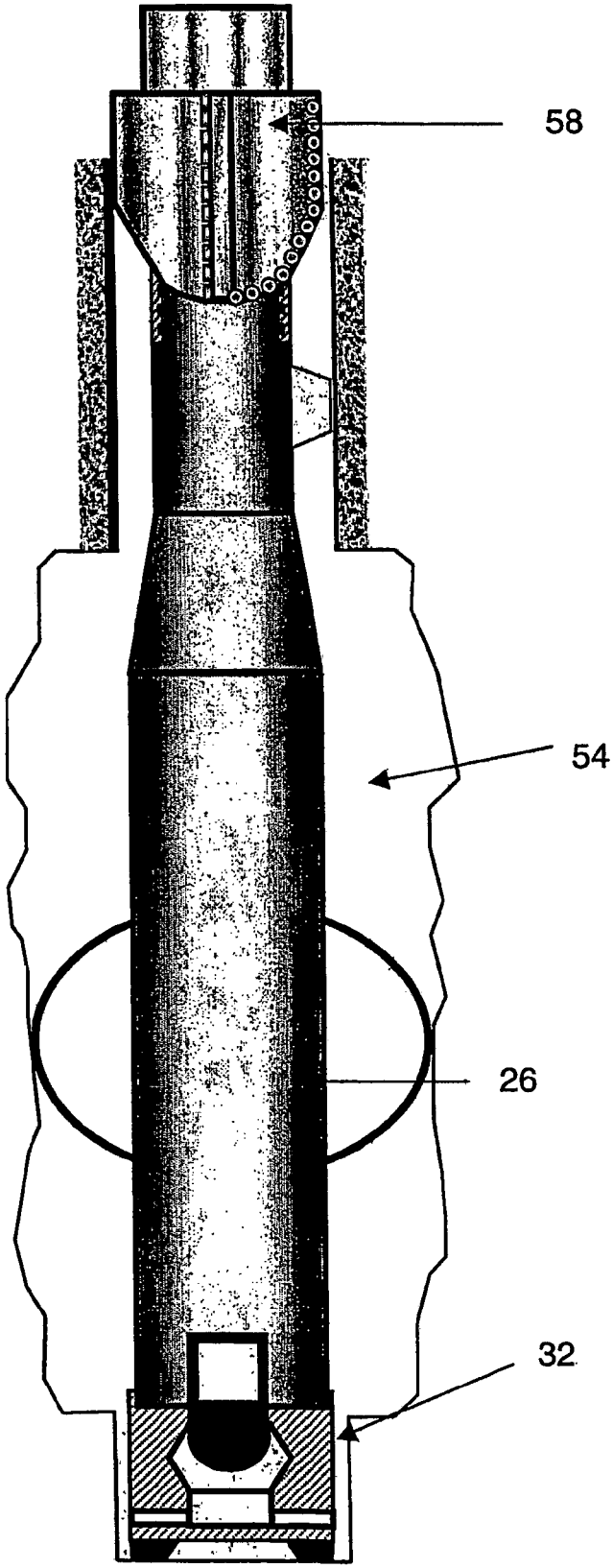
FIG. 6 shows the liner cemented in place.
Figure 7:
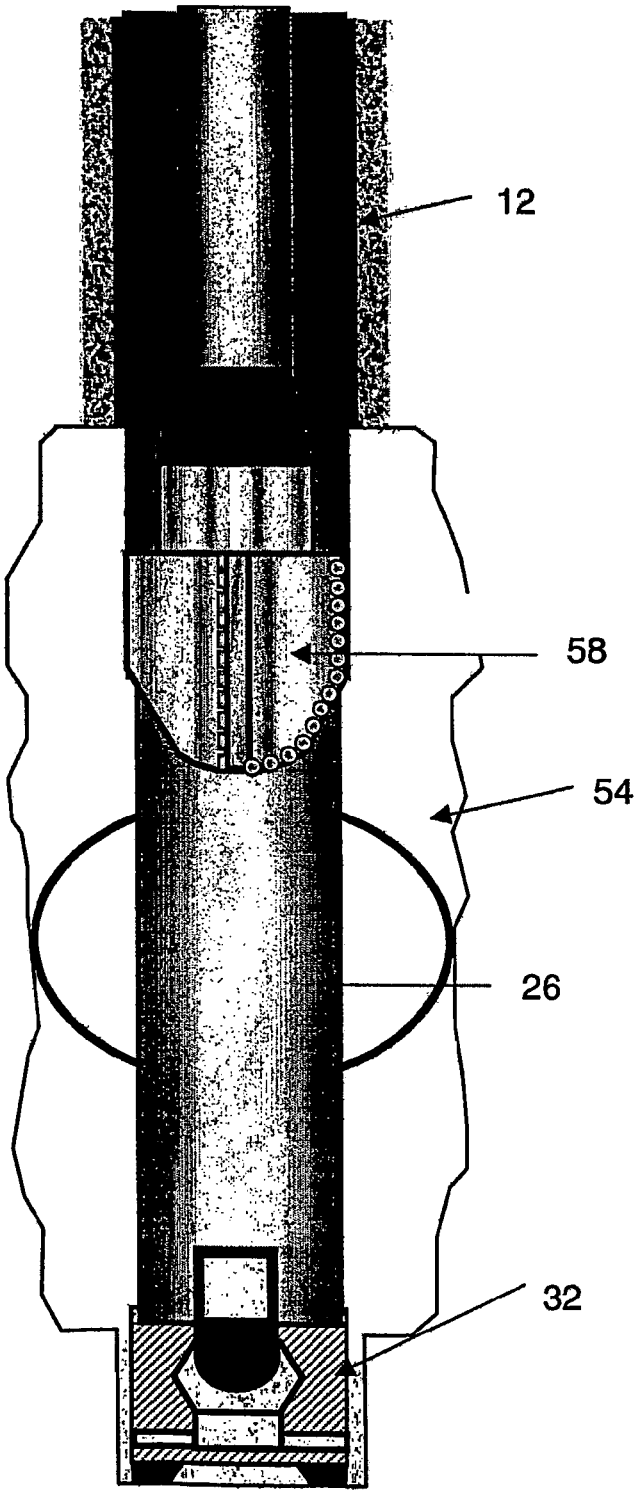
FIG. 7 shows the liner partially drilled out.

Once the cement has set (FIG. 6), drilling is commenced using a milling bit 58 of the same diameter as the previous cased zone 12. This is used to drill down through the liner 26 and part of the cement sheath 54 and to drill out the float shoe 32 at the bottom (FIG. 7).

Figure 8:
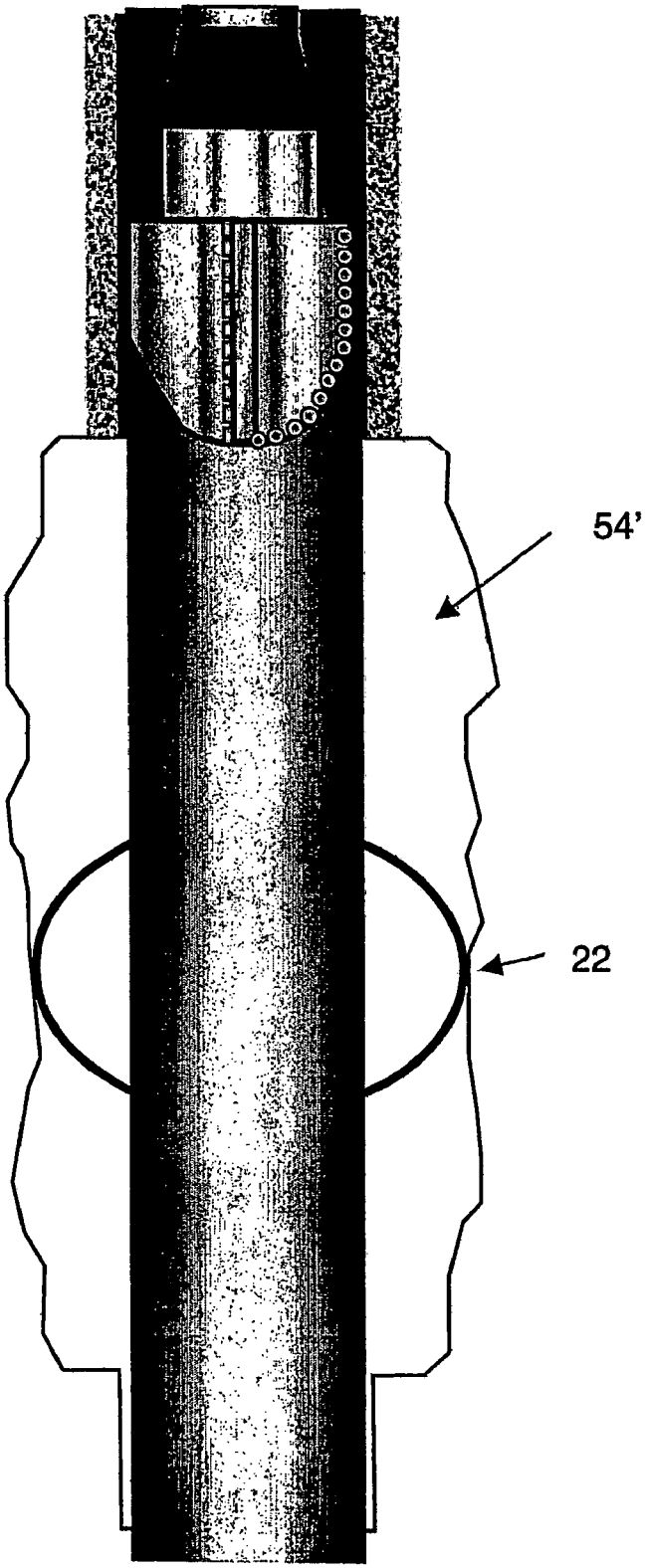
FIG. 8 shows the borehole after the liner has been drilled out.

Once the liner 26 and float shoe 32 are drilled out (FIG. 8) a cement sheath 54 is left on the borehole wall in the zone 18. Thus the problem zone 18 is stabilised and drilling can recommence without further problems in that zone.

While the invention has been described in the context of cementing a problem zone below a cemented borehole, it will be appreciated that it is not restricted to this application. For example, the operation described above can be repeated immediately below a zone that has already been stabilised in the same way. Alternatively, the region above might not be cased or cemented if it is itself stable and supportive. Thus it is possible that the number of casing run in a well can be significantly reduced when compared to wells drilled using previous techniques, allowing the borehole diameter to be maintained to the target depth.

In an alternative embodiment of the invention, the liner has a substantially constant diameter. In this case, the diameter of the liner is selected such that the portion extending into the zone above leaves a sufficient annulus in the upper zone for proper cement placement, both in the problem zone and in the area of overlap of the liner in the upper zone. In this case, the amount of cement to be drilled out is greater.

Also, in the case described above, the upper zone has been cemented using a normal casing shoe at the bottom of the upper casing. In another embodiment of the invention, the installation of the liner is preceded by cementing the casing in the upper zone using a casing shoe that has oversized inside and outside diameters. In this case, the enlargement can be started in the upper zone such that the cement sheath produced is anchored in the upper zone as well as in the problem zone leading to greater stability. Alternatively, or in addition, the casing shoe in the zone above can be extended using drillable tubulars to give a similar effect and benefit.

The invention claimed is:

1. A method of stabilising a zone of interest of a borehole surrounding a formation, comprising:

(i) forming a region of the borehole having enlarged diameter in the zone of interest when compared to the adjacent zone above;

(ii) positioning a drillable liner in the borehole extending across the zone of interest and into the adjacent zone above, said drillable liner forming an annulus between the outside of the liner and the borehole in the zone of interest, the drillable liner having a drill pipe connected with a setting tool, wherein the drill pipe:

extends therethrough to a lower portion, is connected to a float shoe at the lower portion which has side ports for communication with the annulus and cross webs to engage in the formation at the lower portion, and is connected to a cement supply at the surface;

(iii) pumping cement from the surface inside the drill pipe so as to exit the drillable liner at the lower portion and flow upwards to fill the annulus and to extend into the adjacent zone above;

(iv) withdrawing the drill pipe from the drillable liner; and (v) drilling through the cement and drillable liner in the zone of interest after the cement has set to form a borehole of substantially similar diameter to that of the adjacent zone above.

2. A method according to claim 1, wherein the zone above the zone of interest is an open, well-consolidated and stable zone; or lined with cemented casing or sheath.

3. A method according to claim 1, wherein the zone above is a zone that has been previously stabilised by use of a drilled liner.

4. A method according to claim 1, wherein the region of enlarged diameter is formed using an under-reamer or a bi-centre bit.

5. A method according to claim 1, wherein a bit pilot hole is provided at the bottom of the enlarged section.

6. A method according to claim 1, wherein centralisers are provided to centralise the drillable liner, both in the zone of interest and in the zone above.

7. A method according to claim 1, wherein the drillable liner is positioned in the zone in a fluid-filled state.

8. A method according to claim 7, wherein as the drill pipe is withdrawn from the drillable liner, fluid is pumped through the drill pipe to maintain the drillable liner in its fluid-filled state and to displace any cement in the zone above.

9. A method according to claim 1, wherein the drill pipe connects to the upper part of the drillable liner by means of a threaded connector or any other releasable connector.

10. A method according to claim 1, wherein a dart landing sub can be provided inside the drill pipe near the bottom thereof.

11. A method according to claim 1, wherein when the cement has been placed, the drill pipe is disconnected from the drillable liner and drilling fluid circulated through the drill pipe inside the drillable liner to prevent cement from filling the drillable liner and to displace cement above the drillable liner.

12. A method according to claim 1, wherein the cement is a fibre-reinforced cement.

13. A method according to claim 12, wherein the fibres are metallic or formed from a suitable polymeric material.

14. A method according to claim 1, wherein the zone of interest comprises a zone that has mechanical stability problems, a formation experiencing shear failure or creep or plastic flow, an unconsolidated formation, a formation with narrow pore or fracture gradient margins or narrow kick or loss windows, or a formation susceptible to differential sticking problems due to large differences between drilling fluid hydrostatic pressure and formation pressure.

15. A method according to claim 1, wherein the portion of the drillable liner extending into the adjacent zone above has a smaller diameter than that part of the drillable liner in the zone of interest.

16. A method according to claim 1, wherein the drillable liner has a substantially constant diameter.

* * * * *